US005515019A

United States Patent [19]

Schedele

[11] Patent Number: 5,515,019

[45] Date of Patent: May 7, 1996

[54] POLARIZED POWER RELAY

[75] Inventor: Helmut Schedele, Diessen, Germany

[73] Assignee: Siemens Aktiengesellschaft, Munich, Germany

[21] Appl. No.: 335,845

[22] PCT Filed: May 3, 1993

[86] PCT No.: PCT/DE93/00383

§ 371 Date: Nov. 8, 1994

§ 102(e) Date: Nov. 8, 1994

[87] PCT Pub. No.: WO93/23866

PCT Pub. Date: Nov. 25, 1993

[30] Foreign Application Priority Data

May 15, 1992 [DE] Germany ..... 42 16 076.6

[51] Int. Cl.[6] ..... H01H 51/22

[52] U.S. Cl. ..... 335/78; 335/80; 335/130

[58] Field of Search ..... 335/76–86, 124, 335/128, 130

[56] References Cited

U.S. PATENT DOCUMENTS

| | | | |
|---|---|---|---|
| 4,551,698 | 11/1985 | Aida | 335/78 |
| 4,688,010 | 8/1987 | Nobutoki et al. . | |
| 4,914,410 | 4/1990 | Diem et al. | 335/80 |
| 5,243,312 | 9/1993 | Schedele | 335/128 |
| 5,289,145 | 2/1994 | Schedele | 335/78 |

FOREIGN PATENT DOCUMENTS

| | | |
|---|---|---|
| 0186160 | 7/1986 | European Pat. Off. . |
| 0197391 | 10/1986 | European Pat. Off. . |
| 2146407 | 3/1973 | Germany . |
| 2148377 | 4/1973 | Germany . |
| 2453980 | 5/1976 | Germany . |
| 521019 | 3/1972 | Switzerland . |
| 1340150 | 12/1973 | United Kingdom . |
| 1360582 | 7/1974 | United Kingdom . |

*Primary Examiner*—Lincoln Donovan
*Attorney, Agent, or Firm*—Hill, Steadman & Simpson

[57] ABSTRACT

A relay has a polarized magnetic system (2) with a three-pole magnet (17) arranged above a coil (14) and rocking armature (18) which actuates a contact spring (30) arranged beneath the coil by means of a frontally arranged slide (23). The contact spring (30) is inserted from one side into the base body, by means of an elongated spring carrier (29), whereas a counter contact element (33) is inserted therein from the opposite side. This relay allows with a compact design long insulating sections between the magnetic system and the set of contacts, as well as a short circuit-resistant design of the set of contacts.

13 Claims, 5 Drawing Sheets

POLARIZED POWER RELAY

BACKGROUND OF THE INVENTION

The invention relates to a polarized electromagnetic relay having a coil, an elongated permanent magnet which is arranged above the coil and parallel to the coil axis and which has like end poles at each of its two ends and a center pole opposite thereto in its center, having a core which is arranged inside the coil and which is coupled at both ends to the two ends of the permanent magnet by means of yoke legs and also having an elongated rocking armature which is mounted above the center pole of the permanent magnet and forms a working air gap with each of the two yoke legs.

Such a relay having a three-pole magnet and a rocking armature mounted above the magnet is disclosed, for example, in European reference EP-A-O 197 391. In the latter, however, the contact system is also arranged above the coil in the region of the armature, the contact springs arranged on both sides of the armature being directly linked to it and performing their switching movements directly with the armature.

The same magnet system having a three-pole permanent magnet and a rocking armature is also already used in German reference DE-A-21 48 377. However, in that case permanent magnet and armature are arranged to the side of the coil and actuating pins attached to the armature ends act on contact springs which are underneath the coil and can be moved in a plane parallel to the base plane of the relay.

Common to these known relays is the fact that the contact elements are situated with small spacings in the region of the armature and of the magnet system. These systems are consequently suitable only for switching low currents.

European reference EP-A-186 160 (corresponding to U.S. Pat. No. 4,688,010) furthermore discloses a relay for switching higher powers in which a housing is subdivided into a coil enclosure for receiving an electromagnet system and a switching enclosure for receiving a contact arrangement. An armature which carries a permanent magnet is arranged in front of the end face of the coil and fits into the contact enclosure by means of a firmly molded-on actuating arm.

SUMMARY OF THE INVENTION

The object of the present invention is to exploit the advantages of the polarized system described at the outset, namely the high sensitivity accompanied by optionally adjustable monostable or bistable switching characteristics and the low sensitivity of the centrally mounted armature to vibrations, for switching higher currents and voltages.

According to the invention, this object is achieved in a relay of the type mentioned at the outset in that the armature is mounted by means of a bearing spring which is attached directly to its center section and can be latched to the permanent magnet on both sides, in that a contact assembly having at least one contact spring arranged approximately parallel to the coil axis and at least one fixed contact element is arranged underneath the coil and in that there is arranged in front of one end face of the coil a slide which can be moved perpendicular to the coil axis and is made of insulating material and which is coupled, on the one hand, to a movable end of the armature and, on the other hand, to a movable end of the contact spring.

In the case of the invention, therefore, the contact elements are arranged at the underside of the relay right next to the connection side, so that short connecting elements do not generate unduly high heat losses even when carrying high currents. Since the armature with the iron parts of the magnet system is situated opposite the contact elements on the upper side of the coil, a large insulating clearance between contact system and magnet system is already produced as a result of the spatial distance. In addition, the coil and the entire magnet system can be screened by suitable structural design of a main body to create long insulating clearances with respect to the contact system. Such a main body, in which, for example, the contact assembly having connecting elements brought out to the underside is arranged, preferably forms a partition between contact assembly and coil, at which partition side walls formed on at the bottom surround the contact assembly and/or side walls formed on at the top surround the magnet system in a U-shaped or trough-shaped manner. The partition may additionally have a laterally open slot into which an insulating-material plate is inserted. In this way, three insulating-material walls situated one above the other are obtained between contact assembly and coil and this ensures the voltage-sustaining capability required for certain applications. The insulating-material slide which is arranged at one end face of the coil and which produces a link between armature and contact system may create labyrinth-like insulating clearances as a result of suitable overlaps with the main body. Expediently, the slide has in each case recesses into which deformable ends of the contact spring, on the one hand, and of the armature, on the other hand, fit.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
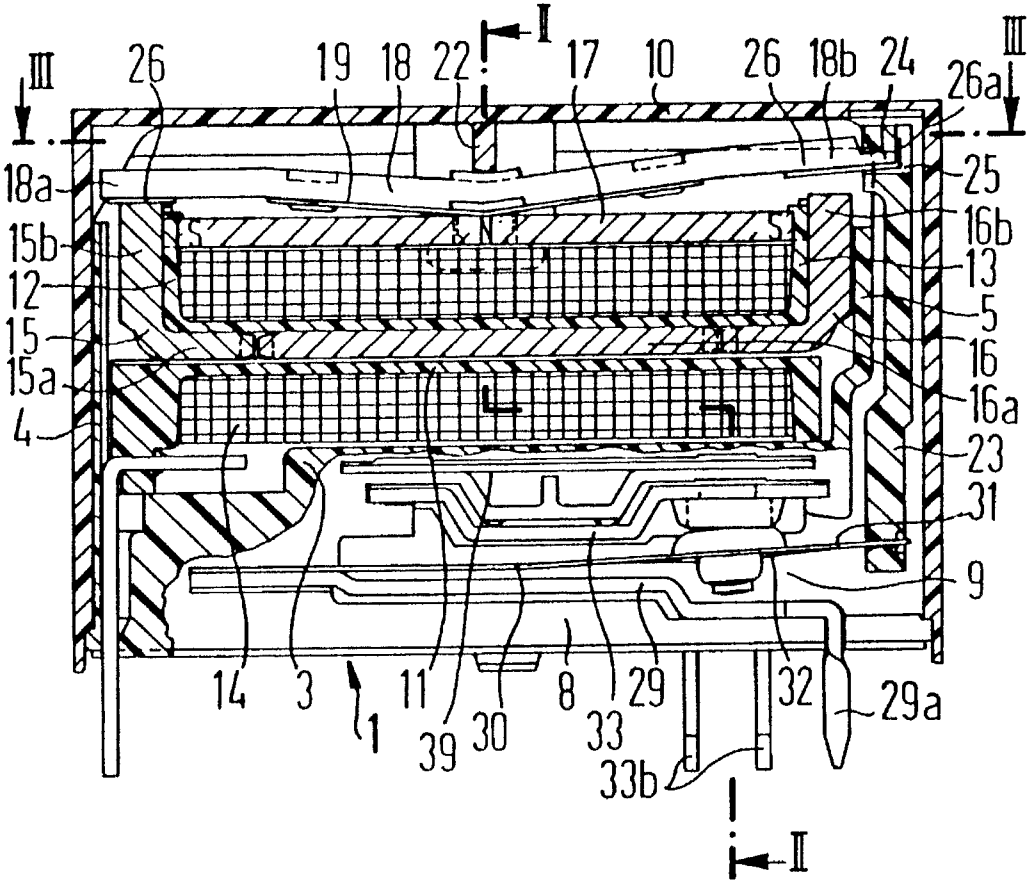
FIGS. 1 to 3 show a first embodiment of a relay designed according to the invention in three different sectional views.

The relay shown in FIGS. 1 to 4 has a main body 1 having a central partition 3 which is arranged parallel to the base side and on which side walls 4 and 5 and also 6 and 7 formed on at the top form a trough-like recess for a magnet system 2 which can be inserted from above. At the bottom the partition 3, together with a parallel base wall 8 and an extension of the side wall 4, surrounds in an approximate U-shape a contact enclosure 9 which is open on the right in FIG. 1. Together with a cap 10 which can be mounted from above, the main body 1 forms a housing which is closed all round.

The magnet system 2 has a tubular coil former 11 having end flanges 12 and 13 between which a winding 14 is arranged. Inserted from both sides into the tubular opening of the coil former 11 is one core yoke 15 or 16 having a core leg 15*a* or 16*a*, respectively, in each case so that the two yoke legs 15*b* and 16*b*, which are bent at right angles, project upwards in parallel. Arranged between the two yoke legs above the coil and parallel to the coil axis is a rod-like three-pole magnetized permanent magnet 17 which has like poles, for example S, in each case in the region of the two yoke legs and a pole opposite thereto, for example N, in the center region. The permanent magnet comprises, for example, an AlNiCo alloy and may in this case simply be cut out of a strip. The magnet can be attached to the coil former by thermoplastically deforming the coil flanges. The core yokes 15 and 16 are also fixed to the coil former in a suitable manner.

Figure 4:
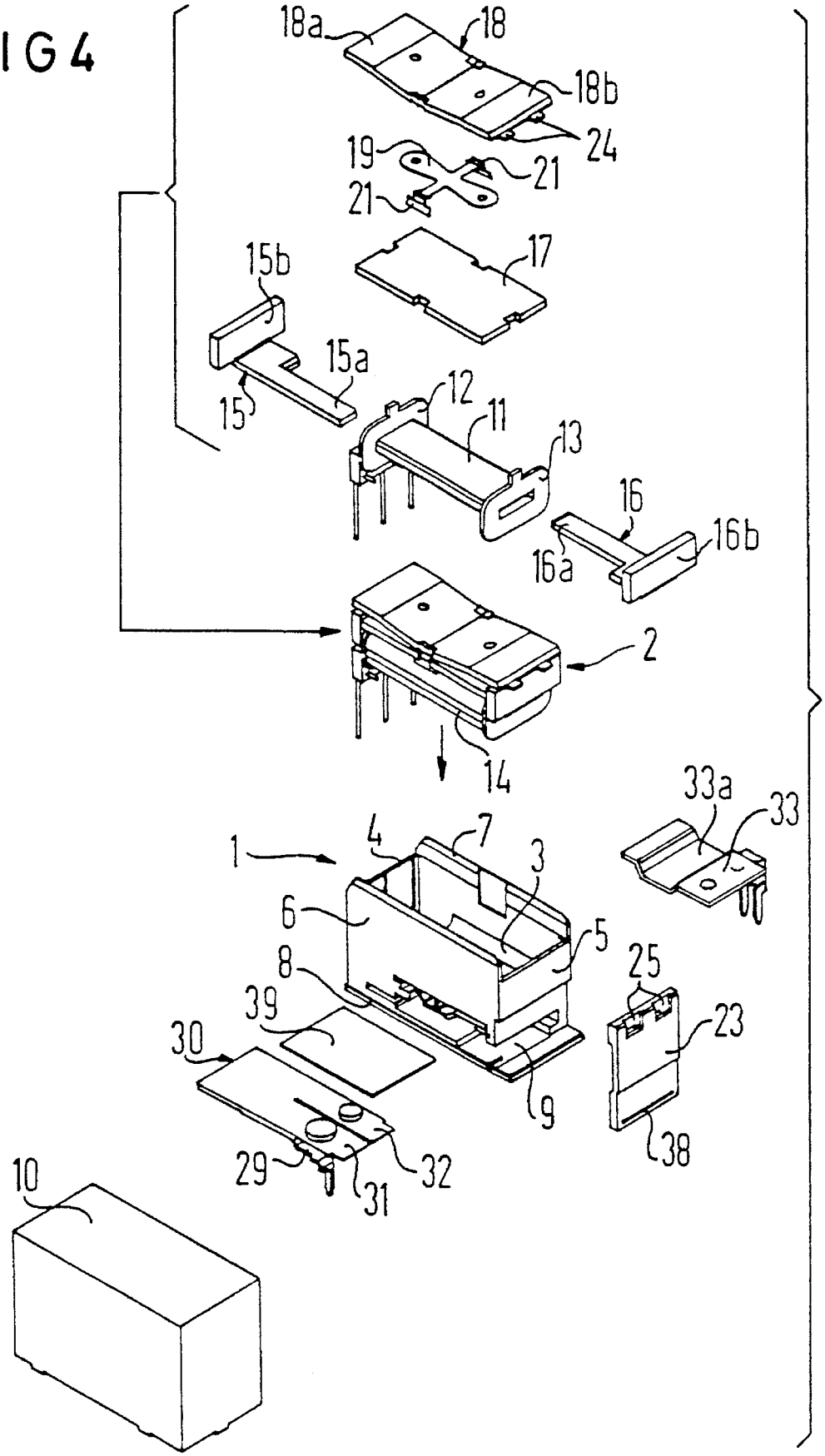
FIG. 4 shows an exploded diagram of the relay of FIGS. 1 to 3 with an additional diagram of the preassembled magnet system.

From FIG. 4 it is evident that the core legs 15*a* and 16*a* are designed in a step-like manner so that, when situated next to one another, they form a large overlap region. In this way, the two core yokes can be of identical design and, nevertheless, make possible a good flux transmission between the two parts.

The number of parts and manufacturing steps is consequently reduced.

An armature 18 designed as a rocker is mounted on the center pole N of the permanent magnet 17. In its center region, the armature is bent slightly in a V-shaped manner towards the permanent magnet so that the ends 18*a* and 18*b* each form an air gap with the corresponding yoke leg 15*b* or 16*b*, respectively. A bearing spring 19 which preferably comprises ferromagnetic material serves to mount the armature, which bearing spring 19 is attached to the lower side of the armature by riveted joints 20 to the latter and is attached by latching with laterally bent latching tabs 21 in corresponding recesses of the permanent magnet 17. The bearing spring 19 forms a torsion strip bearing for the armature. This arrangement and shape of the bearing spring ensures that the armature is frictionlessly mounted and that, at the same time, a good flux transmission takes place from the permanent magnet 17 to the armature 18. Furthermore, the armature is held or secured in the bearing from above by a rib 22 formed on the cap 10. Since the armature is mounted at its center of gravity, its switching state is largely insensitive to vibrations.

Figure 5:
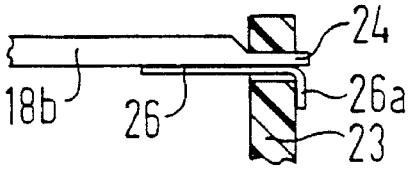
FIGS. 5 and 6 show two details, modified with respect to FIG. 1, of the coupling between armature and slide.
Figure 6:
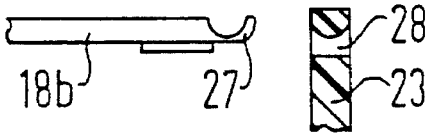

The armature movement is transmitted via a slide 23 to a contact spring assembly which has still to be described, the slide being arranged between the side wall 5 of the main body and a side wall of the cap 10 and being capable of moving perpendicular to the connecting plane or to the coil axis. This arrangement of the insulating slide between insulating walls produces long labyrinth-like creepage clearances and air clearances between the metal parts of the magnet system and the contact spring assembly. The coupling between anchor 18 and slide 23 takes place through (two) extensions 24 of the armature end 18*b* which fit into corresponding recesses 25 of the slide. In addition, for securing purposes, a separating plate 26 having one retaining tab 26*a* in each case is provided which, according to FIG. 1 may be bent upwards or, according to the detailed drawing in FIG. 5, may be bent downwards. Another coupling possibility is shown in the detailed diagram of FIG. 6. In this case, a hook-like extension 27 which is hooked into a suitably designed recess 28 of the slide 23 is formed on in each case to the armature end 18*b*. Other embodiments of this coupling are also conceivable.

The contact spring assembly arranged in the contact enclosure 9 underneath the coil has a contact spring 30 which is attached to a spring support 29 and is split up at its free end in a fork-like manner into two spring legs 31 and 32. A fixed, normally open contact element 33 is arranged above the contact spring 30. At the same time, a movable main contact piece 34 mounted on the spring leg 31 forms, with an oppositely situated fixed main contact piece 35 of the contact element 33, a main contact whose contact pieces comprise noble metal. In addition, an early contact whose contact pieces comprise tungsten or a comparable metal in a known manner is formed with a movable early contact piece 36 on the spring leg 32 and an oppositely situated, fixed early contact piece 37 on the contact element 33.

Figure 2:
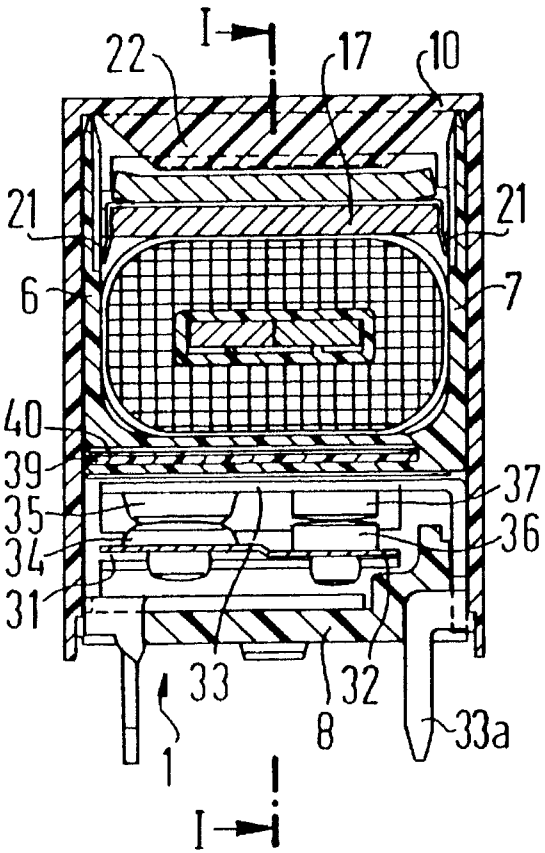
Figure 3:
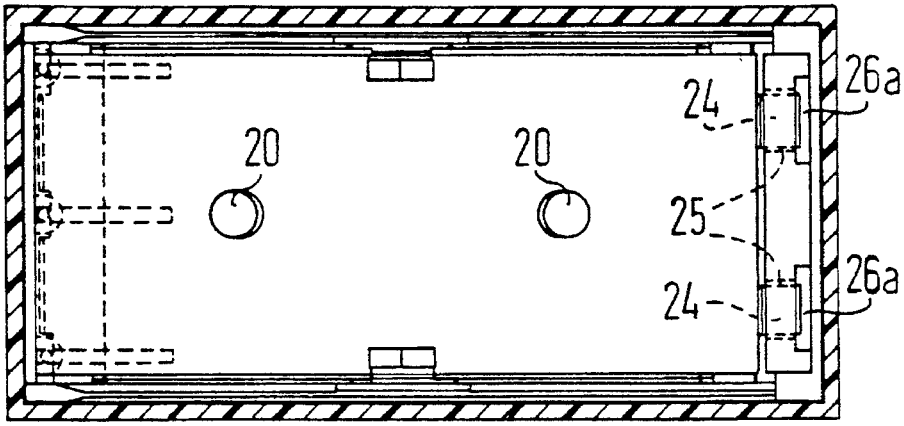

During the assembly, the contact spring support 29 and the fixed, normally open contact element 33 are inserted into the main body 1 which is U-shaped in the lower section from different sides, and in particular, the spring support 29 is inserted from one side, in FIG. 2 from the left, and the normally open contact element 33 is inserted from the right in FIG. 2. The mounting takes place in each case by pressing into corresponding insertion grooves.

Complete support of the spring support 29 on the base wall 8 is achieved by additionally twisting the connecting pin 29*a*. This measure produces for the contact spacing a narrow tolerance zone which provides the condition for obtaining low variations in the characteristic relay values.

Figure 7:
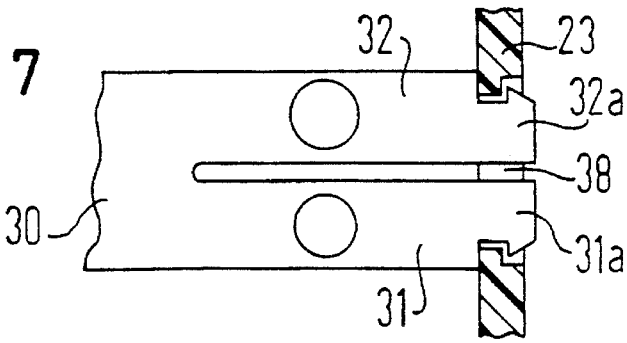
FIG. 7 shows an embodiment of the coupling between contact spring and slide.

Furthermore, during the assembly, the lower end of the slide 23, which has a recess 38, is pushed over the hook-shaped ends 31 a and 32*a* of the contact spring and latched. This is shown in FIG. 7.

Incidentally, during the assembly, the magnet system 2 is pressed from above as an exact fit between the side walls 4, 5, 6 and 7 and additionally fixed by gluing. This eliminates a subsequent alignment. For the purpose of additionally improving the insulation between magnet system and contact enclosure, at the point where the spacing between magnet system and contact region is less than 2 mm an insulating film 39 is inserted into a main-body slot 40 on the long side. As a result of this measure, the three insulating walls required by VDE regulations are produced.

In the present case, the spring support 29 is produced from a nonmagnetic material with good electrical conduction, for example a copper alloy. Since the connecting pin 29*a* of the spring support is located in the vicinity of the right-hand edge of the main body in FIG. 1, while the attachment point of the contact spring is near the left-hand edge, the spring support extends almost over the entire length of the relay. The current path of the spring support is deliberately designed in this way long enough between connecting pin and spring attachment for opposite current directions in the spring support, on the one hand, and in the contact spring, on the other hand, to be able to generate electrodynamic forces which increase the normally open contact force. Very high contact forces are consequently intended to be generated during a short circuit, which reduce the contact resistance and consequently reduce the risk of welding.

However, the contact force increase due to the above-mentioned opposite current directions between spring support and spring might not under some circumstances be sufficient in the event of prolonged service life of the relay because the spacing between the spring support 29 and the contact spring 30 becomes increasingly larger in the course of time because of the contact erosion at the contact pieces. This increasing erosion also reduces the contact forces which are exerted by the magnet system on the contact spring via the slide. Consequently, in the event of a short circuit there might nevertheless be the risk of a functional failure if the relay had performed a fairly large number of switching cycles.

In order to counteract this danger, the normally open contact element comprises in the present case ferromagnetic material; in addition, it is crimped in its center section 33*a* (which switching current does not flow through) so that, in this region, it is situated as near the contact spring 30 as possible. This has the following effect: a short-circuit current flowing in the center spring generates a magnetic field which would tend to attract the ferromagnetic, normally open contact element. Since the latter is firmly anchored, however, in the main body, the contact spring together with its contact piece 34 is, on the contrary, attracted to the fixed, normally open contact element 33. The force of attraction becomes all the greater the smaller the spacing between the contact spring 30 and the normally open contact element 33. In the short-circuit case, this additional type of contact force reinforcement has the very particular advantage that the force of attraction and, consequently, also the contact force becomes larger with increasing contact erosion.

Thus in the case of the combination present here the two different types of contact force reinforcement, namely, on the one hand, the repulsion of the contact spring by its spring support 29 with current flowing through it and, on the other hand, the attraction to the ferromagnetic, normally open contact element 33 add in the combination present here. If, in the event of contact erosion, the one effect becomes smaller, the other effect becomes larger at the same time so that the relay remains fully serviceable during its entire service life even in the event of a short circuit. The high short-circuit contact forces which occur prevent a welding of the contacts because of the low contact resistance produced.

The ferromagnetic, normally closed contact element 33 has, in addition, the further advantage that it attracts the arc which is produced in the case of the tungsten early contact 36, 37 during switching on and off. As a result, the main contact 34, 35, which comprises, for example, silver, is less heavily contaminated by the tungsten evaporation. The electrical conductivity of tungsten is, after all, lower than that of silver for the same contact force by a factor of 3.5. The lower conductivity of the normally open contact element 33 is, however, taken into account by two parallel connecting pins 33*b*.

A particular advantage of the combination, according to the invention, of polarized rocking armature/magnet system with the contact assembly described above is also that the contact is closed at the top by means of a movement of the armature arm 18*b*. Consequently, the shorter normally open contact element can be arranged above the longer spring support 29, between the contact spring 30 and the coil 14. This results in a particularly beneficial space utilization underneath the coil former, as a result of which a particularly compact structure of the relay is made possible.

However, a modification of the relay would also be conceivable in which a further counter contact element would additionally be arranged beneath the contact spring in order to form a double-throw contact in this way. The spring support 29 would then have to be shaped differently in a suitable manner.

Figure 8:
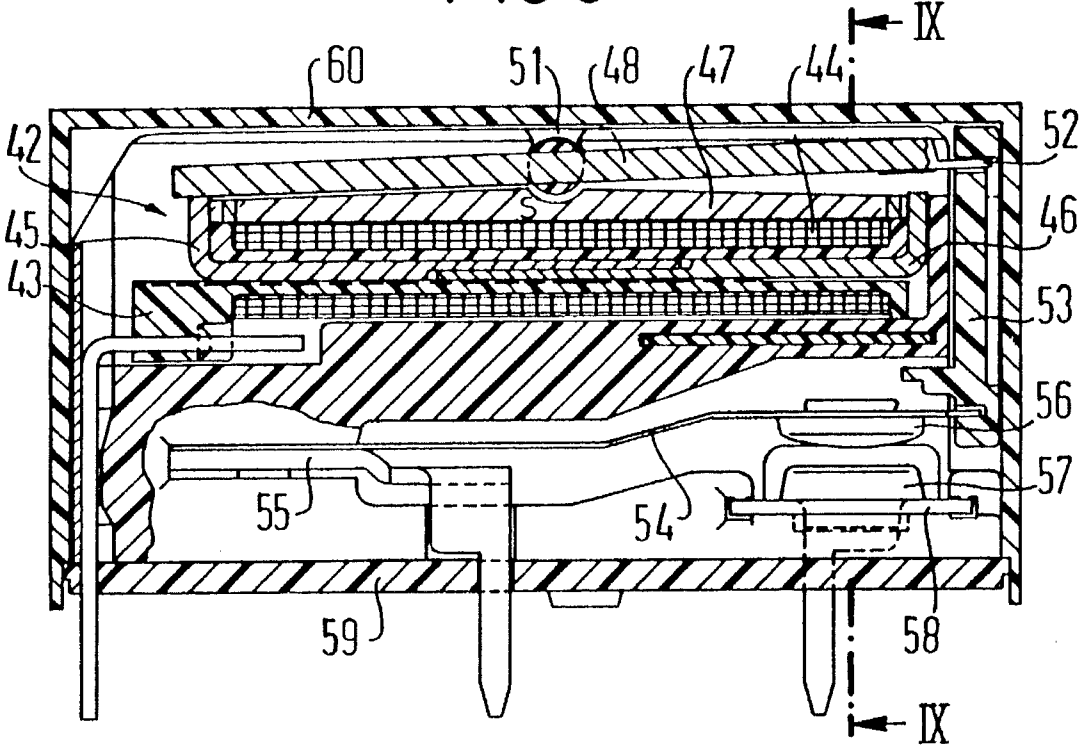
FIGS. 8 to 10 show a second embodiment of a relay designed according to the invention in three sectional views.
Figure 9:
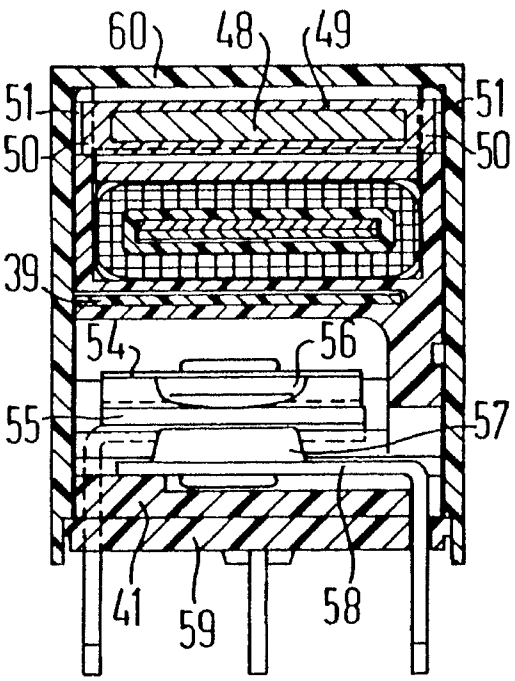
Figure 10:
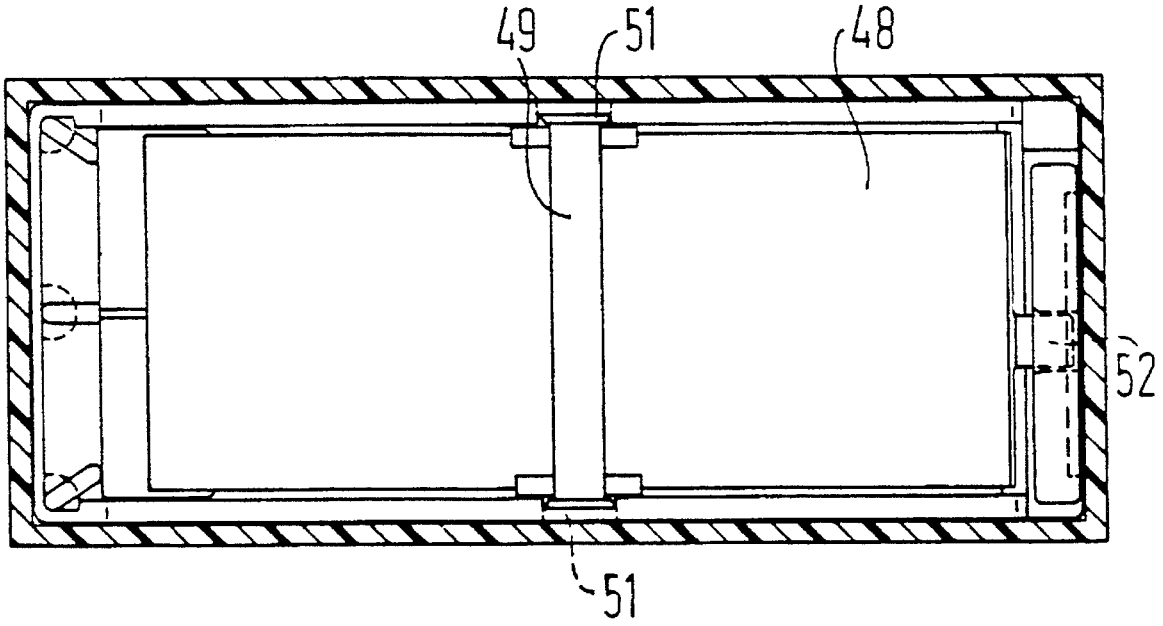

FIGS. 8 to 10 show yet a further embodiment of a relay designed in accordance with the invention. If individual parts of this exemplary embodiment are not described in detail, they are identical or similar to the previous exemplary embodiment.

The relay shown in FIGS. 8 to 10 has a main body 41 which is essentially of trough-shaped design in the upward direction and of U-shaped design in the lower section, like the main body 1. Inserted into the upper part of the main body is a magnet system 42 which has a coil former 43 having a winding 44 and two L-shaped core yokes 45 and 46. In this case, the core yokes are stepped in such a way that they lie one on top of the other in the center region and, in this way, have larger contact areas in the overlap region. However, in this case, they cannot be of identical design. A three-pole magnet 47 situated on the coil is of thicker design in the region of its center pole and tapered towards the two end poles so that the armature 48 mounted above the center pole and designed as a flat plate can perform a rocker movement, in all cases alternatively, towards one of the two core yokes.

The armature 48 is enclosed by injection molding in its center region by a plastic ring 49 which forms a pivot pin 50 on both sides of the armature. The armature is rotatably mounted on both sides in bearing holes 51 of the main body by means of said pivot pins 50.

Formed onto the right-hand end of the armature is an actuating finger 52 which is coupled to a slide 53 and, as in the preceding case, moves the latter in front of the end face of the coil and perpendicularly to its axis. The slide 53 actuates a contact spring 54 which is mounted in the main body by means of a spring support 55. A contact piece 56 of the contact spring interacts with a contact piece of a normally open contact element 58 which is also anchored in insertion grooves of the main body. A baseplate 59 forms, together with a cap 60, a housing which encloses the relay on all sides.

Of course, various combinations of individual elements from the two exemplary embodiments described are also possible, in particular as regards the design of the contact elements and the configuration as normally closed, normally open or double-throw contact.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A polarized electromagnetic relay comprising:

a coil having a coil axis;

an elongated permanent magnet which is arranged above the coil and parallel to the coil axis and which has like end poles at each of two ends thereof and a center pole opposite thereto in a center thereof, a core which is arranged inside the coil and which is coupled at both ends thereof to the two ends of the permanent magnet by means of yoke legs, an elongated rocking armature which is mounted above the center pole of the permanent magnet and which forms a working air gap with each of the two yoke legs the armature being mounted by means of a bearing spring which is attached directly to a center section thereof and which can be latched on both sides to the permanent magnet, a contact assembly having at least one contact spring arranged approximately parallel to the coil axis and having at least one fixed contact element arranged underneath the coil, and a slide arranged in front of one end face of the coil which is movable perpendicular to the coil axis and which is made of insulating material and which is coupled to a movable end of the armature and to a movable end of the contact spring.

2. The relay as claimed in claim 1, wherein the contact assembly is arranged in a main body made of insulating material with connecting elements brought out to an underside thereof and is screened by said main body in a box-like or labyrinth-like fashion from the magnet system.

3. The relay as claimed in claim 2, wherein the main body forms a partition between the contact assembly and the coil, wherein side walls formed on the partition at a top surround the magnet system and/or side walls formed on the partition at the bottom surround the contact assembly.

4. The relay as claimed in claim 3, wherein the partition has a slot into which an insulating-material plate is insertable from one side.

5. The relay as claimed in claim 3, wherein the main body has side walls which are drawn upward in trough-like fashion and between which the magnet system can be pressed in as a fit and can be fixed in an aligned position.

6. The relay as claimed in claim 1, wherein the slide has recesses into which are fit deformable end sections of the contact spring and an extension of the armature.

7. The relay as claimed in claim 1, wherein the armature is substantially straight and is mounted above the center pole of the permanent magnet, the center pole being raised with respect to the end poles.

8. The relay as claimed in claim 1, wherein the permanent magnet has substantially a shape of a straight beam and wherein the armature is bent away slightly from the end poles of the permanent magnet at both ends thereof.

9. The relay as claimed in claim 1, wherein the contact spring has a rigid support inserted from one side thereof into a retaining groove of the main body and a fixed, normally open contact element inserted into mounting grooves of the main body from an opposite side.

10. The relay as claimed in claim 1, wherein a juncture between the contact spring and a support thereof is situated opposite a contact point thereof and wherein the contact spring and the support extend approximately parallel and at a small spacing from one another over a substantial section of their length.

11. The relay as claimed in claim 10, wherein the normally open contact element has an elongated ferromagnetic section which extends opposite the contact spring and parallel to the contact spring over a substantial section thereof.

12. The relay as claimed in claim 1, wherein the contact spring is split, the contact spring having a first spring leg forming a main contact, formed with noble metal with the normally open contact element and having a second spring leg forming an early movable contact formed with refractory material.

13. The relay as claimed in claim 1, wherein the core comprises two identical L-shaped parts.

* * * * *